US005515702A

United States Patent [19]

Park

[11] Patent Number: 5,515,702

[45] Date of Patent: May 14, 1996

[54] NOISE SHIELDING APPARATUS OF WASHER

[75] Inventor: Chun-Kwon Park, Seoul, Rep. of Korea

[73] Assignee: Samsung Electronics Co., Ltd., Suwon, Rep. of Korea

[21] Appl. No.: 280,948

[22] Filed: Jul. 27, 1994

[30] Foreign Application Priority Data

Jul. 30, 1993 [KR] Rep. of Korea ..... 93-14582 U

[51] Int. Cl.[6] ..... D06F 37/26

[52] U.S. Cl. ..... 68/3 R; 134/201

[58] Field of Search ..... 68/3 R; 134/58 D, 134/56 D, 57 D, 201; 62/269

[56] References Cited

U.S. PATENT DOCUMENTS

| | | | |
|---|---|---|---|
| 2,247,028 | 6/1941 | Kuntz | 62/296 |
| 3,112,623 | 12/1963 | Crossman | 62/296 |
| 5,056,341 | 10/1991 | Mori et al. | 68/3 R |

FOREIGN PATENT DOCUMENTS

| | | | |
|---|---|---|---|
| 62-109599 | 5/1987 | Japan | 68/3 R |
| 62-148695 | 5/1987 | Japan | 68/3 R |
| 1-209097 | 8/1989 | Japan | 68/3 R |
| 1-209098 | 8/1989 | Japan | 68/3 R |
| 1-310696 | 12/1989 | Japan | 68/3 R |

*Primary Examiner*—Frankie L. Stinson
*Attorney, Agent, or Firm*—Burns, Doane, Swecker & Mathis

[57] ABSTRACT

A clothes washer comprises a housing in which a washing tub is disposed. A noise shielding plate extends across the bottom of the housing. A first edge of the shielding plate is removably connected in a groove of the housing to permit the plate to be swung up and down within a chamber formed by the housing. A resilient securing device is retracted to allow the plate to swing up or down and then snaps back into place.

6 Claims, 5 Drawing Sheets

FIG. 2
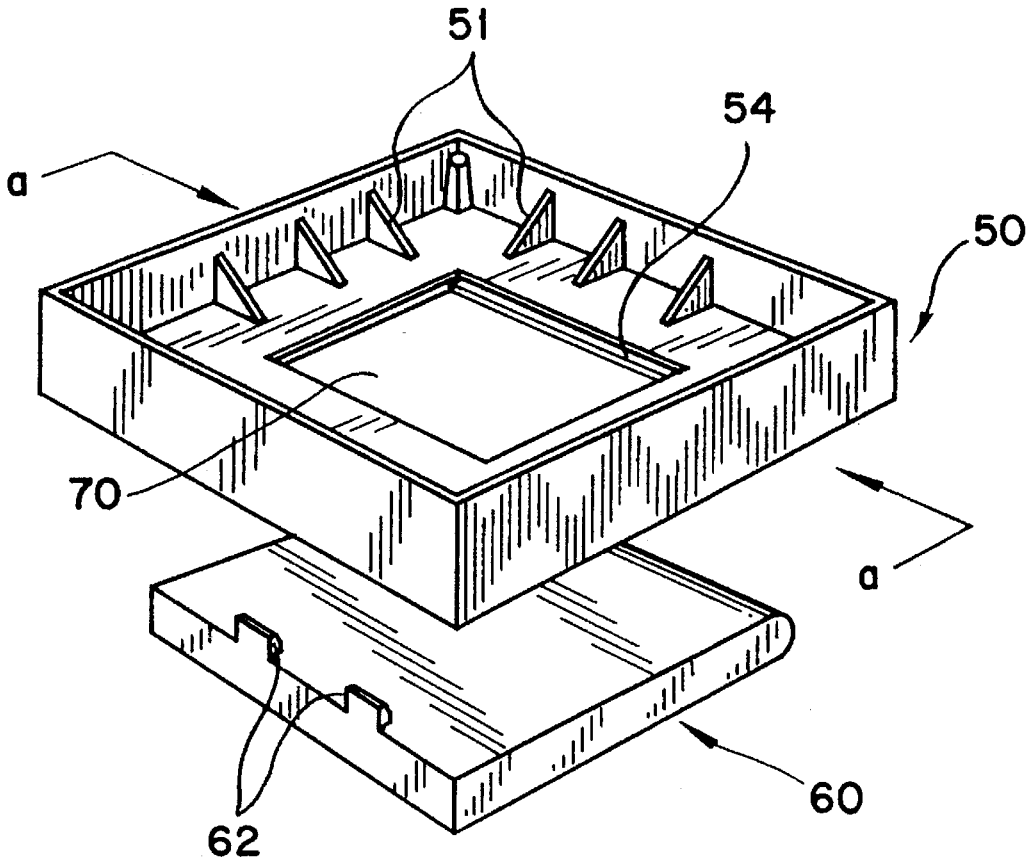
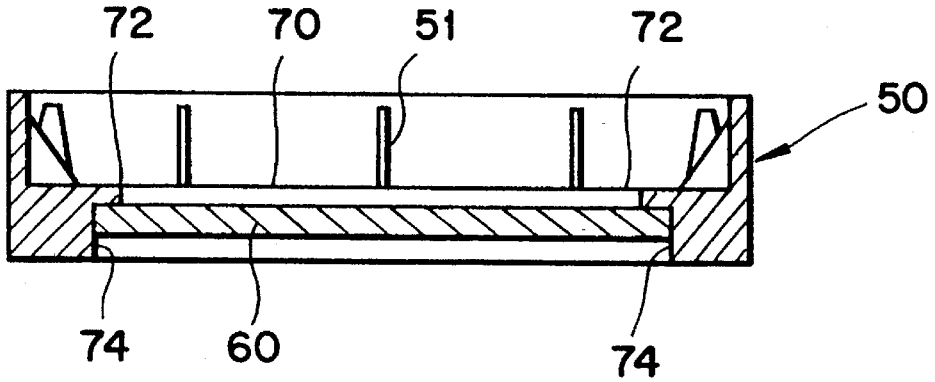
FIG. 3

FIG. 4
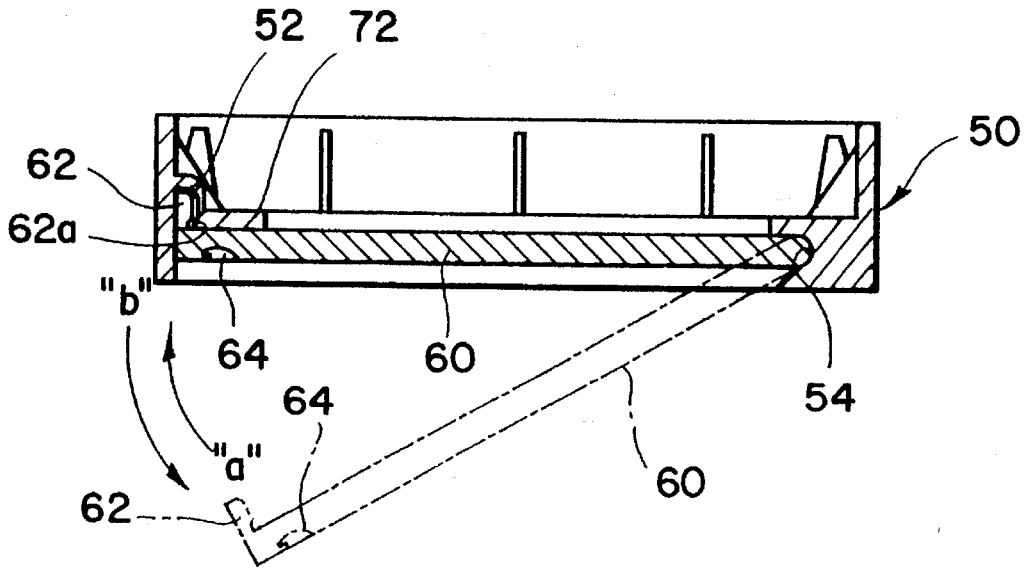
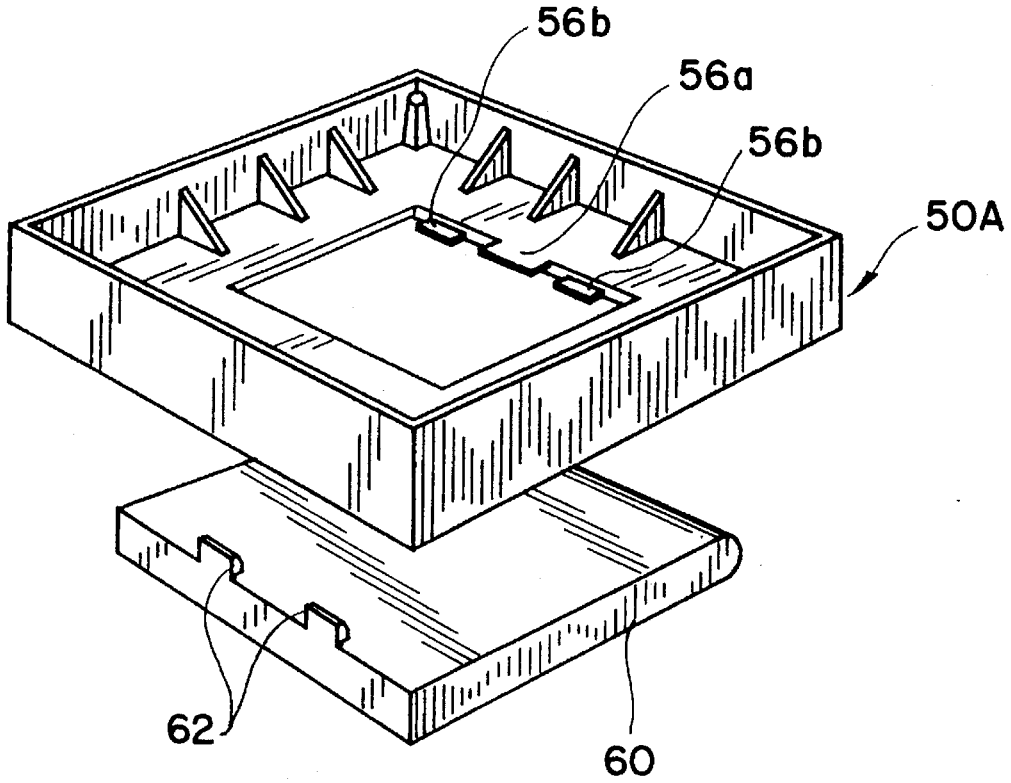
FIG. 5

NOISE SHIELDING APPARATUS OF WASHER

BACKGROUND OF THE INVENTION

1. Field of the Invention

The present invention relates to a noise shielding apparatus for preventing the noise generated in the operation of a washing machine (washer) from being discharged to the outside through a lower area of the washer, thereby causing the same to operate in a noise-free state.

2. Description of the Prior Art

Generally, a washer, as illustrated in FIG. 6, comprises: a housing body 3, a wash tub 1 disposed in the housing 3 for receiving laundry and washing water; a driving unit 2 for driving (rotating) the washing tub 1 or an agitator (not shown); a body for forming an external appearance thereof while encompassing the washing tub 1 and the driving unit 2; a lid 4 for closing a top area of the washer; a base 5 for comprising a lower area of the washer and for supporting the washing tub 1, the driving unit and the housing body 3.

Meanwhile, the washer thus described inevitably creates noise due to operation of the driving unit 2 and the like, whilst the noise is not discharged through the top area and sides thereof due to the shielding function of the housing body 3, the lid 4 and the like but discharged mainly through the lower area thereof.

Accordingly, in order to prevent the noise from being discharged through the lower area of a conventional washer, the base has been disposed with a sliding type sound insulation plate 6.

In other words, the base 5 is disposed with upper and lower guide plates 5*a* and 5*b* whereby the insulation plate 6 is guided by the guide plates 5*a* and 5*b* to thereby be connected to the base 5.

Protruding fasteners 6*a* formed on frontal area of the insulation plate 6 is fastened to a fastening grooves 5*c* formed on the base 5.

Numeral 5*d* in the drawing is reinforceing member for preventing deformation of the base 5.

FIG. 7 is a perspective view for illustrating in detail the base 5 and the insulation plate 6 in FIG. 6.

According to FIG. 7, the base 5 has a rectangular shape of a predetermined height with the upper guide plates 5*a* and lower guide plates 5*b* formed therein.

A plurality of reinforcing members 5*d* are also formed therein in order to prevent the deformation of the base 5 and the fastening groove 5*c* is formed on the frontal area of the base 5.

The sound insulation plate 6 is formed with the protruding fastener 6*a* in its front area, and if the plate 6*a* is inserted between the upper guide plates of the base 5 and the lower guide plates 5*b*, the protruding fasteners 6*a* of the insulation plate 6 are insertedly fastened into the fastening grooves 5*c* of the base 5.

However, because the sound insulation apparatus 6 thus described is horizontally slid against the plates 5*a* and 5*b* to thereby be fastened into the base 5, as a result, there is a disadvantage in that the insulating plate 6 may become caught in the guide plates 5*a* and 5*b* during its insertion into the base, thereby making it difficult for the plate 6 to be inserted. Consequently, noise generated by the driving unit 2 through an opening (made for smoothness of sliding operation of the insulation plate) between the base 5 and the insulation plate 6 is discharged to the outside, thereby resulting in a problem of decreasing the sound shielding effect.

SUMMARY OF THE INVENTION

The present invention has been disclosed to solve the aforementioned problems, and it is an object of the present invention to provide a noise shielding apparatus of a washer for causing a sound shielding plate to be smoothly connected to a base of the washer and, at the same time, for preventing a gap from being formed between the sound shielding plate and a connecting unit of the base, thereby avoiding the noise from being discharged to the outside.

In order to achieve the aforesaid object of the present invention, the noise shielding apparatus according to the present invention, wherein a sound shielding plate is disposed in the washer housing for preventing operational noise of the washer from being discharged to the outside through a lower area thereof. One edge of the plate is connected to housing to enable the plate to be swung up and down. A securing device secures the plate in an upward position in which it closes off a lower portion of the housing.

BRIEF DESCRIPTION OF THE DRAWINGS

For a better understanding of the nature and objects of the invention, reference should be made to the following detailed description taken in conjunction with the accompanying drawings in which:

FIG. 2 is a perspective exploded view for illustrating structure of one embodiment of the noise shielding apparatus of a washer according to the present invention;

FIG. 3 is a sectional view taken along line a—a in FIG. 2 in a state where the shielding plate illustrated in FIG. 2 is in an operative position.

FIG. 4 is a side sectional view for explaining how to insert and remove the noise shielding apparatus of a washer according to the present invention;

FIG. 5 is a perspective exploded view for illustrating another embodiment of the noise shielding apparatus according to the present invention;

DETAILED DESCRIPTION OF PREFERRED EMBODIMENTS

Hereinafter, preferred embodiments of the present invention will be described in detail with reference to the accompaning drawings.

Figure 1:
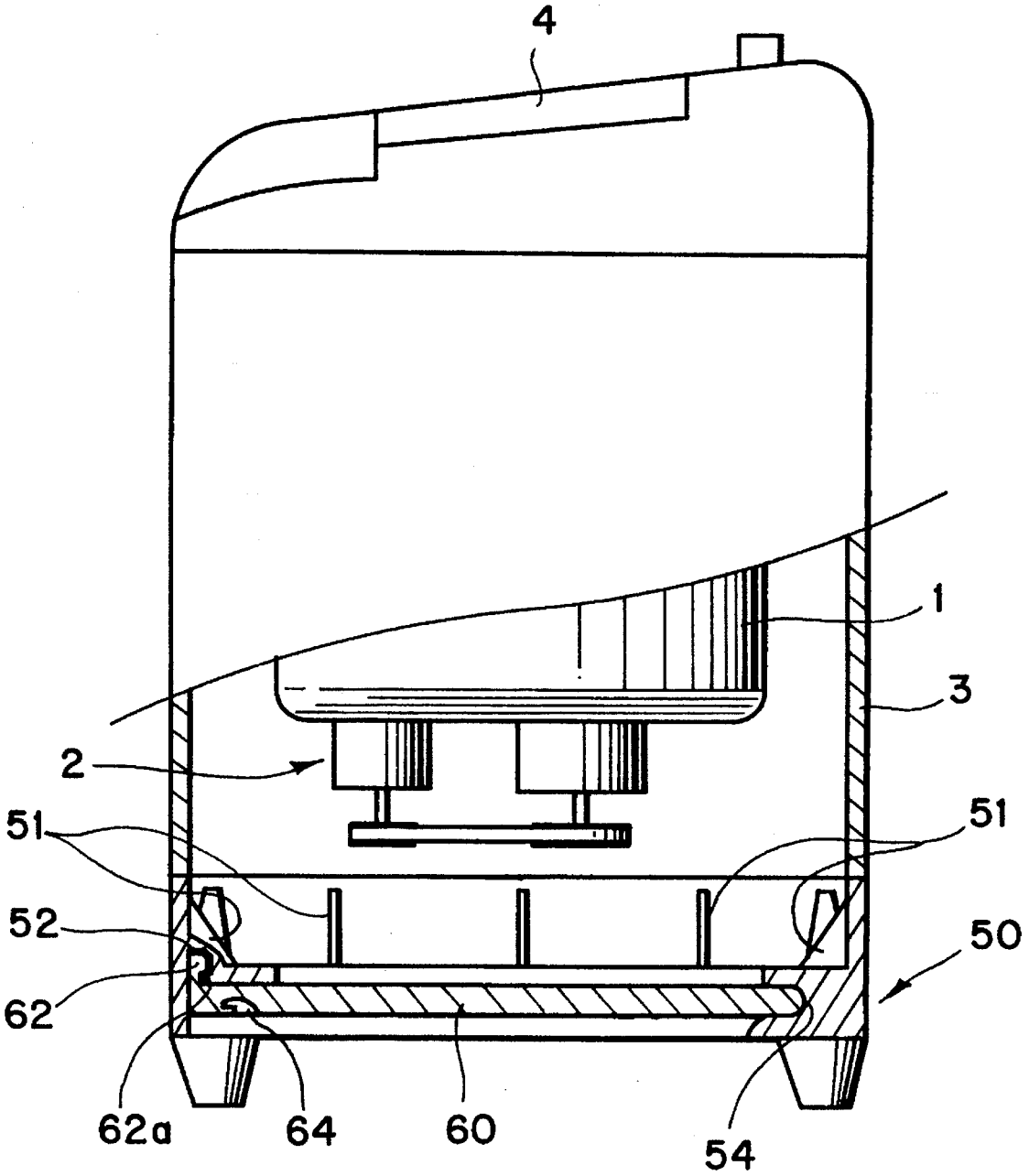
FIG. 1 is a side view of a washer broken at one side thereof where a noise shielding apparatus according to the present invention is applied.
Figure 6:
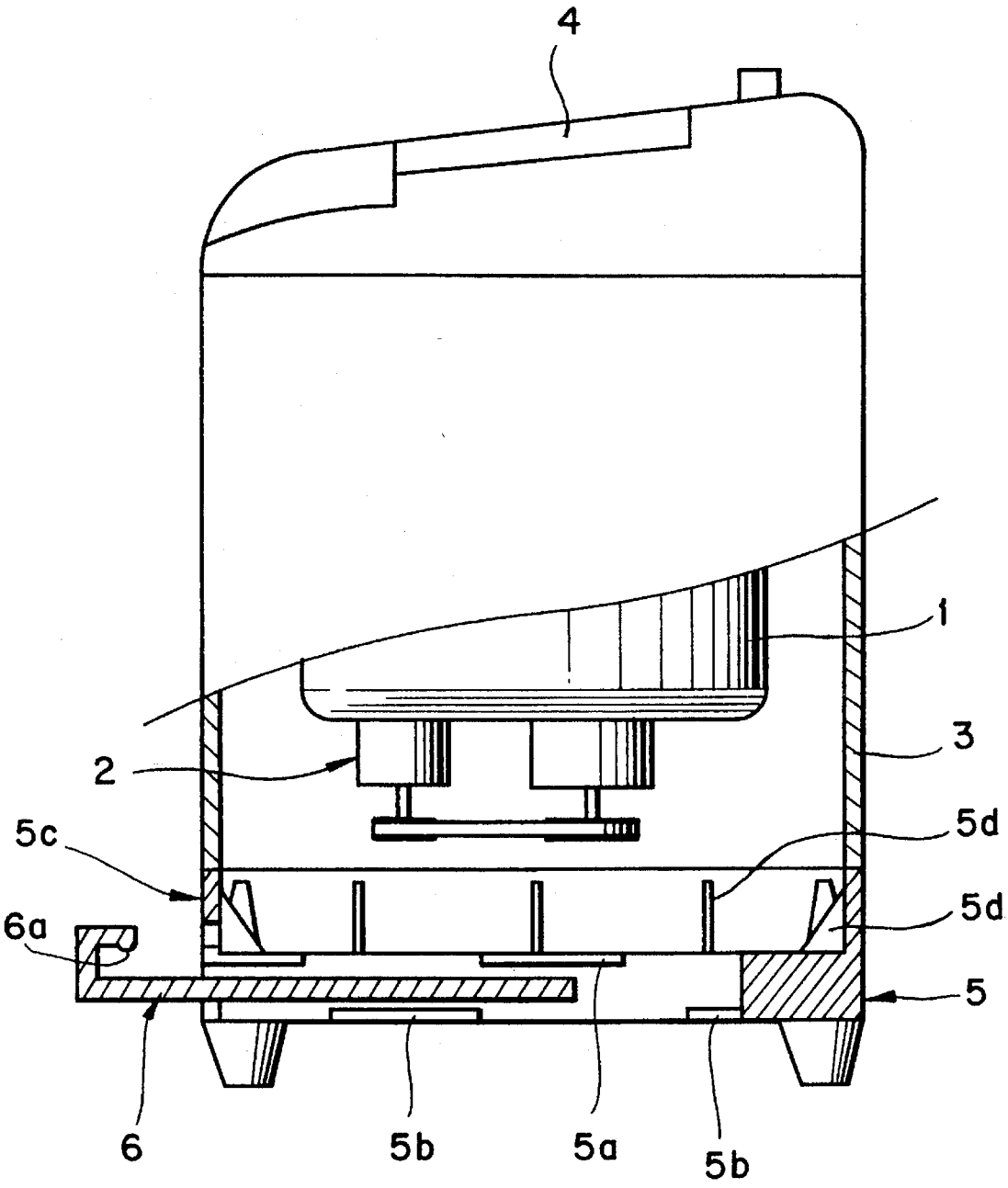
FIG. 6 (PRIOR ART)
FIG. 6 is a side view of a washer broken at its side for illustrating structure of a conventional noise shielding apparatus.
Figure 7:
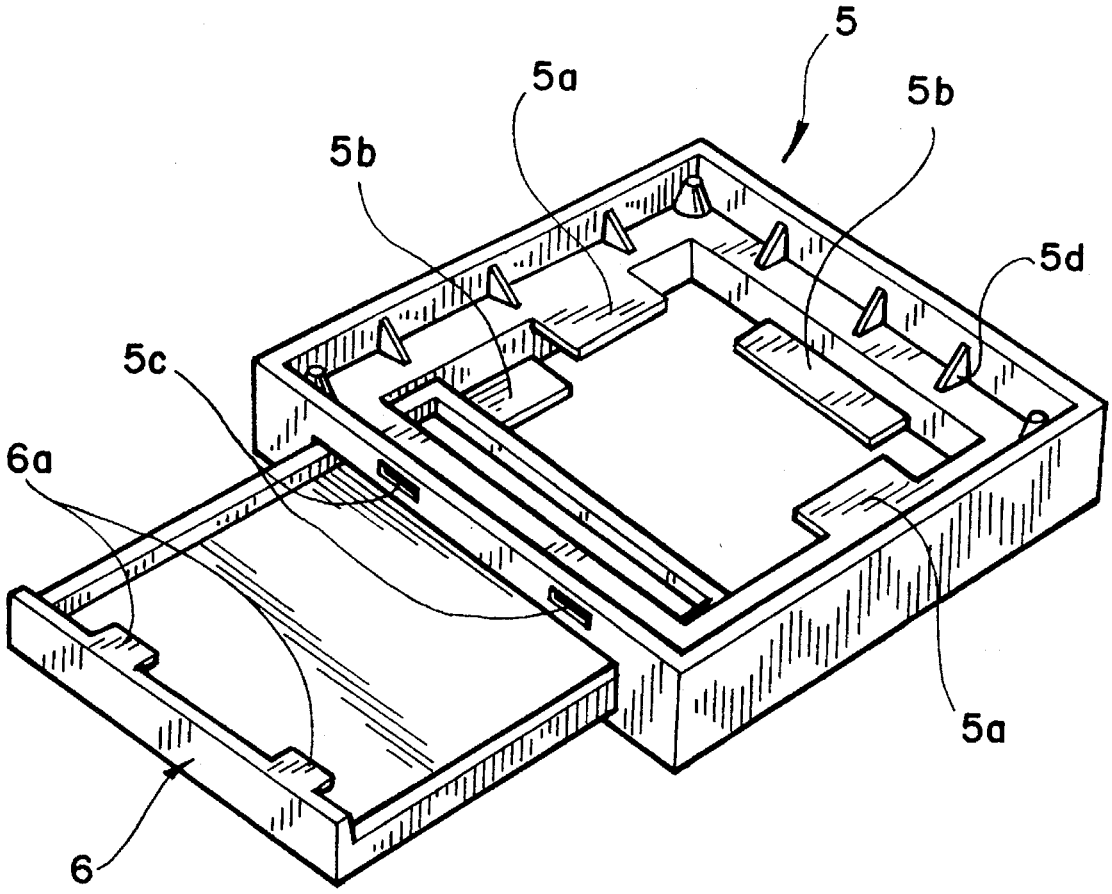
FIG. 7 (PRIOR ART)
FIG. 7 is a perspective view for illustrating in detail the structure of the noise shielding apparatus shown in FIG. 6.

FIG. 1 is a side view of a washer broken at one side thereof where the noise shielding apparatus of a washer according to the present invention is applied.

According to FIG. 1, a connector in the form of a groove 54 is formed at a rear side (right side on the drawing) of a base 50 and more than one downwardly open fastening groove 52 is formed in the underside of a front side of the base (left side on the drawing).

At an entrance side of the fastening groove 52 there is formed a fixing pin 62*a*.

A sound shielding plate 60 is inserted in its rear into the groove 54 formed in the base, and more than one upstanding fastening protruder 62 is formed on a frontal upper side thereof to thereby be connected to the fastening grooves 52 formed in the base 50.

Furthermore, a downwardly open groove-shaped handle 64 is formed at a front side of an underside of the sound shielding plate 60. Alternatively, if the handle is to be releasable, it can be formed as a protrusion on a bottom of the plate 64.

Meanwhile, as illustrated in the FIG. 1, the sound shielding plate 60 is connected to the base 50, so that the facade thereof cannot be exposed to the outside.

Numeral 51 in the drawing is a reinforcing rib, and the washing tub 1, driving unit 2, body 3 and lid 4 are omitted in explanation as the same are of the same structure as the conventional one described earlier herein.

According to FIG. 2, the reinforcing ribs 51 are formed on a topside of the base 50.

A hole 70 is formed centrally in the base 50, to form a stop wall 72 against which the shielding plate may abut from below.

FIG. 3 is a sectional view of a—a line at a state where the shielding plate 60 illustrated in FIG. 2 and the base 50 are connected.

According to FIG. 4, if the plate 60 is to be connected to the base 50, as illustrated in solid lines the rear side or edge of the sound shielding plate 60 is pushed into the groove 54 to form a connection which enables the plate 60 to be swung upwardly in direction "a". The rear edge of the plate is curved and in engagement with a correspondingly curved surface of the groove to facilitate such swinging movement.

When the plate 60 is swung upward, the protrusions 62 enter the grooves 52 of the base 50.

At this time, the fixing pin 62*a* formed at an entrance side of each fastening groove 52 is resilient and is retracted inwardly by the fastening protruder 62 and thereafter snaps back to an original position.

Meanwhile, as seen from the foregoing, when the sound shielding plate 60 is connected to the base 50, side walls 74 formed on either side of the base 50 to define a plate-receiving chamber are closely adhered to respective edges of the plate 60.

Accordingly, there is generated no gap between the plate 60 and the base 50 to thereby prevent the driving noise of the washer from being discharged to the outside.

In order to separate the plate 60 from the base 50, the handle 64 formed underneath the plate 60 is utilized, so that the plate 60 is pulled downward for separation of the plate from the base 50 (in the "b" direction).

When the plate 62 is pulled downward, the fixing piece 62*a* formed at the entrance side of the fastening groove 52 is retracted, thereby separating the fastening protruder 62 from the groove 52, enabling the protrusion 62 to exit. Then, each fixing piece 62*a* returns to the original position by way of its resilience.

At the same time, when the plate 60 is pulled down and then drawn to the front (to the left in the drawing), the plate 60 is released from the groove 54 of the base 50 to thereby separate the plate from the base completely.

FIG. 5 is a perspective view of another embodiment of the noise shielding apparatus according to the present invention.

According to FIG. 5, the converter formed in the rear side of the base 50A comprises at least two upper guide plates 56*a* and one lower guide plate 56*b*.

Accordingly, when the plate 60 is connected to the base 50A, the plate 60 is inserted into a space between the upper guide plate 56*a* and the lower guide plates 56*b*, and then, when the plate 60 is swung upward, the plate and the base become secured as illustrated in the embodiment of FIGS. 1 through FIG. 4.

Of course, the plate 60 can be separated from the base 50 in the same manner as in FIGS. 1–4.

As seen from the foregoing, the noise shielding apparatus of a washer according to the present invention has solved a problem of upper and lower guide plates of the base interfering with movement of the sound shielding plate, so that the sound shielding plate can be easily separated and assembled.

Furthermore, because the sound shielding plate is closely adhered to walls 72, 74 the base, the same can achieve an effect of excellent noise shielding.

The foregoing description and drawings are illustrative and are not to be taken as limiting. Still other variations and modifications are passible without departing from the spirit and scope of the present invention.

Still furthermore, even though the base has been disclosed in a usual example but the same can be proposed in various shapes without departing from the scope of the present invention.

What is claimed is:

1. A washing machine comprising a housing, a washing mechanism disposed in said housing, and a sound shielding plate disposed across a lower portion of said housing, a first edge of said plate being connected to said housing to permit said plate to be swung upwardly and downwardly, and a securing device for releasably securing the plate in an upward position for closing off the lower portion of said housing, wherein said plate includes a second edge disposed opposite said first edge, at least one upwardly extending protuberance formed on said plate adjacent said second edge, said protuberance being receivable in a downwardly open slot disposed in said housing.

2. The washing machine according to claim 1, wherein said lower portion of said housing includes a plate-receiving chamber in which said plate is disposed, said chamber including upright side walls, and a top wall, said top wall including a hole therethrough, said plate extending across said hole in contact with said side and top walls when in said upward position.

3. The washing machine according to claim 1, wherein said securing device comprises a resilient member yieldably engaging said plate.

4. The washing machine according to claim 1, wherein said housing comprises a groove for receiving said first edge.

5. The washing machine according to claim 4, wherein said first edge is curved and in engagement with a correspondingly curved surface of said groove.

6. The washing machine according to claim 1 further including a clothes washing tub disposed in said housing.

* * * * *